US010024543B2

(12) United States Patent
Lee et al.

(10) Patent No.: US 10,024,543 B2
(45) Date of Patent: Jul. 17, 2018

(54) COOKING APPLIANCE

(71) Applicant: LG ELECTRONICS INC., Seoul (KR)

(72) Inventors: Dongjae Lee, Seoul (KR); Yangho Kim, Seoul (KR); Youngsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 547 days.

(21) Appl. No.: 14/607,892

(22) Filed: Jan. 28, 2015

(65) Prior Publication Data

US 2015/0211744 A1 Jul. 30, 2015

(30) Foreign Application Priority Data

Jan. 29, 2014 (KR) ..... 10-2014-0011291

(51) Int. Cl.

| | |
|---|---|
| ***F24C 3/12*** | (2006.01) |
| ***F23D 14/14*** | (2006.01) |
| ***F23D 14/04*** | (2006.01) |
| ***F23N 1/00*** | (2006.01) |
| ***F24C 3/06*** | (2006.01) |

(52) U.S. Cl.

CPC ..... *F24C 3/126* (2013.01); *F23D 14/04* (2013.01); *F23D 14/14* (2013.01); *F23N 1/007* (2013.01); *F24C 3/067* (2013.01); *F23N 2035/14* (2013.01); *F23N 2035/16* (2013.01); *F23N 2035/18* (2013.01); *F23N 2037/02* (2013.01); *F23N 2037/10* (2013.01)

(58) Field of Classification Search

CPC ..... F24C 3/067; F24C 3/126; F23N 1/007; F23N 2035/12; F23N 2035/14; F23N 2035/16; F23N 2035/18; F23N 2037/02; F23N 2037/10; F23D 14/02; F23D 14/04; F23D 14/045; F23D 14/06; F23D 14/065

See application file for complete search history.

(56) References Cited

U.S. PATENT DOCUMENTS

| | | | | |
|---|---|---|---|---|
| 3,606,612 | A * | 9/1971 | Reid, Jr. | F23D 14/145 126/39 J |
| 3,843,313 | A * | 10/1974 | Helgeson | F23D 14/145 126/39 J |
| 5,197,872 | A * | 3/1993 | Bertomeu Martinez | F24C 3/067 431/284 |
| 5,458,294 | A * | 10/1995 | Zachary | F16K 31/0651 239/585.5 |
| 7,523,762 | B2 * | 4/2009 | Buezis | F23N 1/005 137/489 |

* cited by examiner

*Primary Examiner* — David J Laux
(74) *Attorney, Agent, or Firm* — KED & Associates, LLP

(57) ABSTRACT

A cooking appliance is provided. The cooking appliance may include a burner pot having a plurality of mixing spaces and a gas valve device to adjust a flow rate of a gas to be supplied into at least one mixing space of the plurality of mixing spaces.

5 Claims, 7 Drawing Sheets

Fig.5

| VALVE STATE / MODE | COMMON VALVE | FIRST VALVE | SECOND VALVE |
|---|---|---|---|
| HIGH | ON | ON | ON(CHANGE OPENING DEGREE AFTER VALVE IS ENTIRELY OPENED) |
| MIDDLE | ON | ON | ON(OPEN A PORTION OF VALVES) |
| LOW | ON | ON | OFF(CLOSE ENTIRE VALVES) |

COOKING APPLIANCE

CROSS-REFERENCE TO RELATED APPLICATION(S)

The present application claims priority under 35 U.S.C. 119 and 35 U.S.C. 365 to Korean Patent Application No. 10-2014-0011291, filed in Korea on Jan. 29, 2014, which is hereby incorporated by reference in its entirety.

BACKGROUND

1. Field

A cooking appliance is disclosed herein.

2. Background

Cooking appliances are devices to heat food or other items to cook the food or other items. In the cooking appliances, a cooktop heats food using heat generated due to gas combustion. Such a cooking appliance may include at least one burner assembly.

The burner assembly may include an inner pot, into which a mixed gas of a gas and air may be supplied, an outer pot, into which the mixed gas of the gas and air may be supplied, the outer pot being disposed at an outside of the inner port, a combustion mat, on which the mixed gas supplied into the inner and outer pots may be burned, and a valve assembly to supply the gas into the outer and inner pots. The valve assembly may mechanically operate in response to manipulation of a knob and may supply the gas into only the inner pot, or into the outer and inner pots.

In the cooking appliance according to the related art, it is only intended to supply the gas or not intended to supply the gas into the outer pot. Thus, a supply amount of gas may not be adjusted when the gas is supplied into the outer pot. Thus, thermal energy of the burner device may be adjusted in only two-stages.

BRIEF DESCRIPTION OF THE DRAWINGS

Embodiments will be described in detail with reference to the following drawings in which like reference numerals refer to like elements, and wherein:

FIG. 5 is a view illustrating a state of the gas valve unit depending on a thermal energy mode of the burner device according to an embodiment;

DETAILED DESCRIPTION

Figure 1:
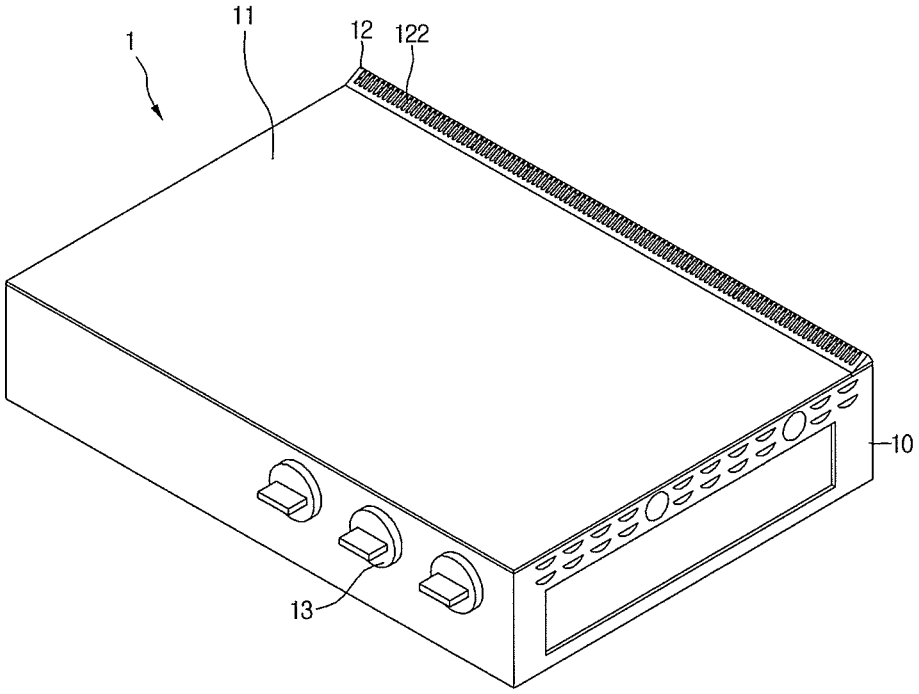
FIG. 1 is a perspective view of a cooking appliance according to an embodiment.

Reference will now be made in detail to embodiments, examples of which are illustrated in the accompanying drawings. Where possible, like reference numerals have been used to indicate like elements, and repetitive disclosure has been omitted.

In the following detailed description of embodiments, reference is made to the accompanying drawings that form a part hereof, and in which is shown by way of illustration specific embodiments which may be practiced. These embodiments are described in sufficient detail to enable those skilled in the art to practice, and it is understood that other embodiments may be utilized and that logical structural, mechanical, electrical, and chemical changes may be made without departing from the spirit or scope. To avoid detail not necessary to enable those skilled in the art to practice, the description may omit certain information known to those skilled in the art. The following detailed description is, therefore, not to be taken in a limiting sense.

Figure 2:
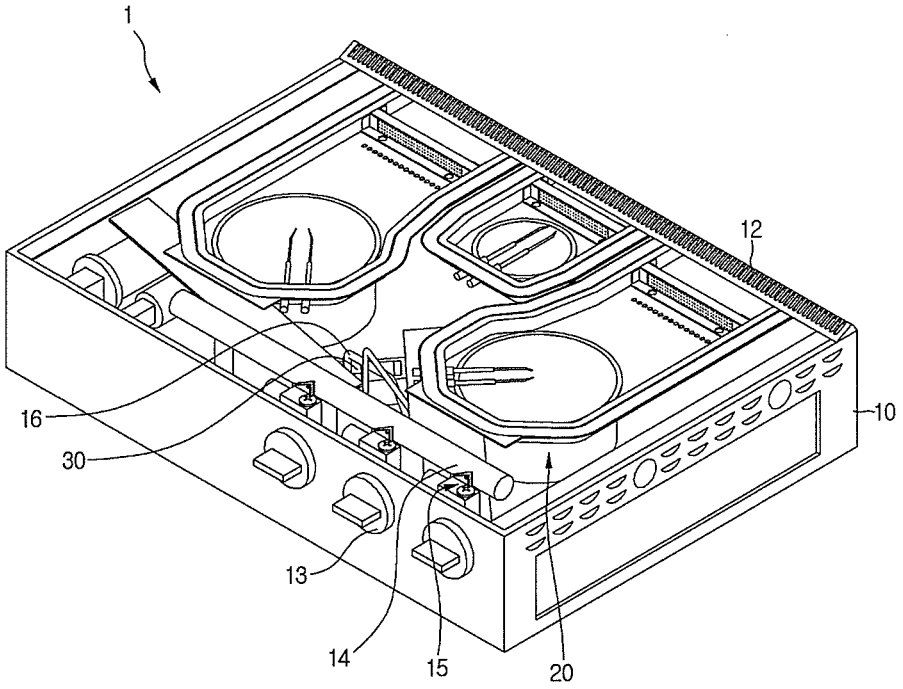
FIG. 2 is a view illustrating a state in which a top plate is removed from the cooling appliance of FIG. 1.

FIG. 1 is a perspective view of a cooking appliance according to an embodiment. FIG. 2 is a view illustrating a state in which a top plate is removed from the cooling appliance of FIG. 1.

Referring to FIGS. 1 and 2, a cooking appliance 1 according to an embodiment may include a case 10, and a top plate 11 seated on the case 10. The cooking appliance 1 may further include at least one burner device or burner 20 accommodated within the case 10 to burn a mixed gas, in which air and a gas are mixed, and a discharge part or discharge 12, through which the gas burned within the burner device 20 may be discharged. The discharge part 12 may be seated on an upper rear end of the case 10.

Although three burner devices 20 are shown disposed within the case 10 in FIG. 2, this embodiments are not limited to the number of burner device 20. The discharge part 12 may include a plurality of discharge holes 122 through which a combustion gas may be discharged.

The cooking appliance 1 may further include a gas supply tube 14, through which the gas supplied into the burner device 20 may flow, a gas valve device 15 to adjust an amount of gas supplied into the burner device 20, a nozzle device or nozzle 30 to spray gas into the burner device 20, a manipulation knob 13 to manipulate the gas valve device 15. The manipulation knob 13 may be disposed on a front surface of the case 10. Each of the gas valve devices 15, the nozzle device 30, and the manipulation knob 13 may be provided in a same number as a number of the burner device 20.

The gas supply tube 14 may be a common supply tube, through which a gas may be supplied into a plurality of the gas valve devices 15. The gas valve device 15 may include an individual supply tube 16, through which the gas may be supplied into the burner device 20.

Hereinafter, a burner device according to embodiments will be described in detail.

Figure 3:
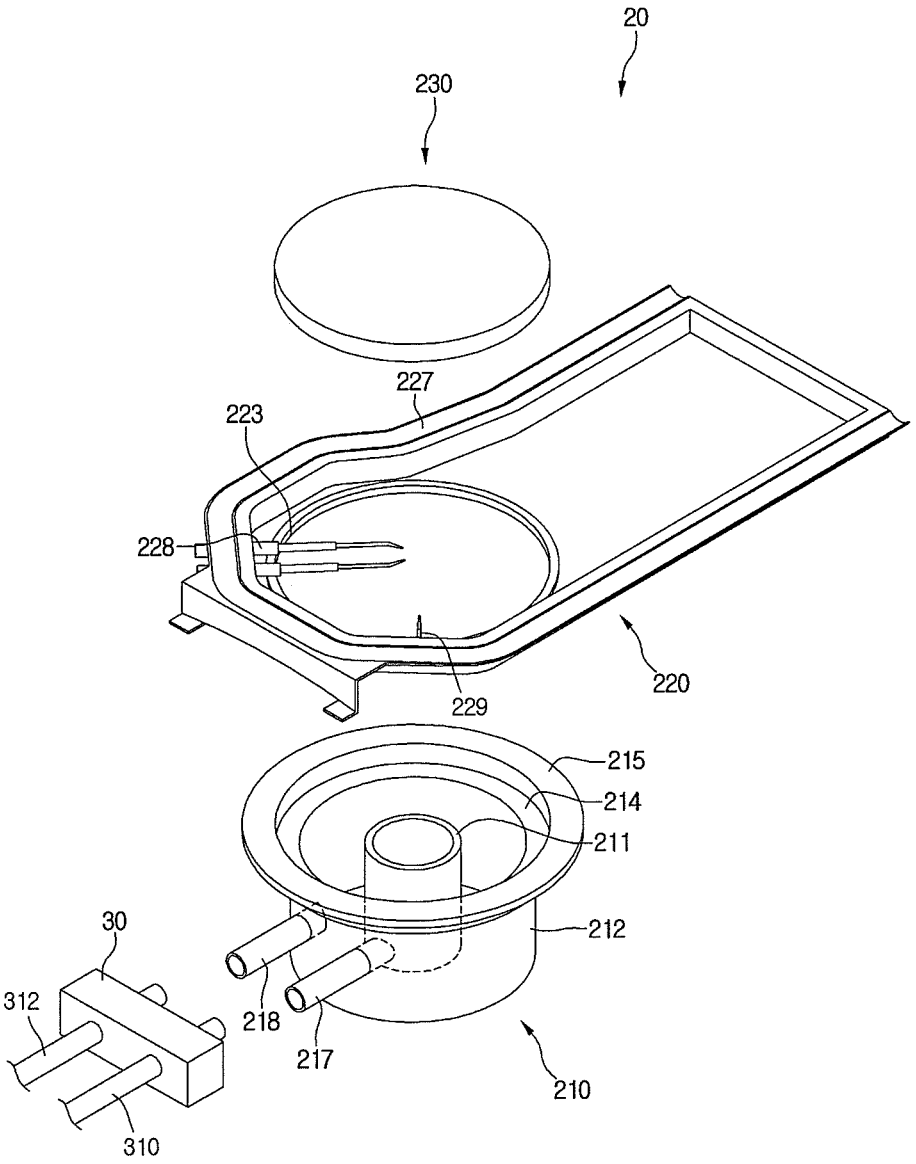
FIG. 3 is an exploded perspective view of a burner device according to an embodiment.

FIG. 3 is an exploded perspective view of a burner device according to an embodiment. Referring to FIG. 3, the burner device 20 may include a burner pot 210, into which the mixed gas may be introduced, a combustion member 230 seated on the burner pot 210 and heated by heat created by burning the mixed gas, and a burner frame 220 seated on the burner pot 210 that provides a discharge passage for the combustion gas burned on the combustion member 230.

The burner pot 210 may include a second pot 212, and a first pot 211 disposed in the second pot 212. The first pot 211 may form an inner space blocked from a space between an outer surface of the first pot 211 and an inner surface of the second pot 212. In this embodiment, the inner space of the first pot 211 may be a first mixing space, and the space between an inner circumferential surface of the second pot 212 and an outer circumferential surface of the first pot 211 may be a second mixing space. Thus, the mixed gas may be supplied into the first pot 211 or into each of the first and second pots 211 and 212 according to a manipulation of the manipulation knob 13.

A first mixing tube 217 may be connected to the first pot 211 in a state in which the first mixing tube 217 passes through the second pot 212. A second mixing tube 218 may be connected to the second pot 212. The first and second mixing tubes 217 and 218 may be integrated with the burner pot 210, for example. Alternatively, the first mixing tube 217 may be connected to the second pot 212, and a guide tube to guide the mixed gas in the first mixing tube 217 to the first pot 212 may be disposed between the first pot 211 and the second pot 212.

Air surrounding each of the mixing tubes 217 and 218 may be introduced into each of the mixing tubes 217 and 218 while the gas is sprayed into each of the mixing tubes 217 and 218 from the nozzle device 30. The gas may be primarily mixed with the air within the mixing tubes 217 and 218, and then, may be secondarily mixed with the air within each of the first and second pots 211 and 212.

A first seating part or seat 214, on which the combustion member 230 may be seated, may be disposed on an upper portion of the burner pot 210, substantially on an upper portion of the second pot 212. When the combustion member 230 is seated on the first seating part 214, the combustion member 230 may cover the first and second mixing spaces at a same time. Thus, the mixed gas in the first pot 211 and the mixed gas in the second pot 212 may be burned.

Alternatively, the combustion member 230 may include a second combustion member having a ring shape to cover the second pot 212, and a first combustion member that covers the first pot 211.

A second seating part or seat 215, on which the burner frame 220 may be seated, may be disposed on the upper portion of the burner pot 210, substantially on the upper portion of the second pot 212.

An ignition part or ignition 228 to burn the mixed gas may be disposed on the burner frame 220. The ignition part 228 may be disposed on an upper side of the combustion member 230. The ignition part 228 may have an end disposed at a position that vertically overlaps the first mixing space of the first pot 211 so that the mixed gas in the first pot 211 may be ignited first.

Thus, the mixed gas passing through the combustion member 230 may be ignited by the ignition part 228 and burned to generate a flame. The combustion member 230 may be heated by the generated flame. The combustion member 230 may be heated, and then, the mixed gas may be burned on the combustion member 230.

A hole 223, through which the gas burned on the combustion member 230 may pass, may be defined in the burner frame 220. The combustion member 230 may pass through the hole 223.

Alternatively, the combustion member 230 may contact a bottom surface of the burner frame 220 without passing through the hole 223. The gas burned by the combustion member 230 may pass through the hole 223.

The burner frame 220 may include a contact part or contact 227 to increase a contact area with the top plate 11. The contact part 227 may horizontally extend at an upper end of the burner frame 220. As the contact part 227 contacts the bottom surface of the top plate 11, flow of the burned gas between the top plate 11 and the burner frame 220 may be prevented.

A temperature sensor 229 to detect a temperature when the mixed gas is burned may be disposed on the burner frame 220.

Figure 4:
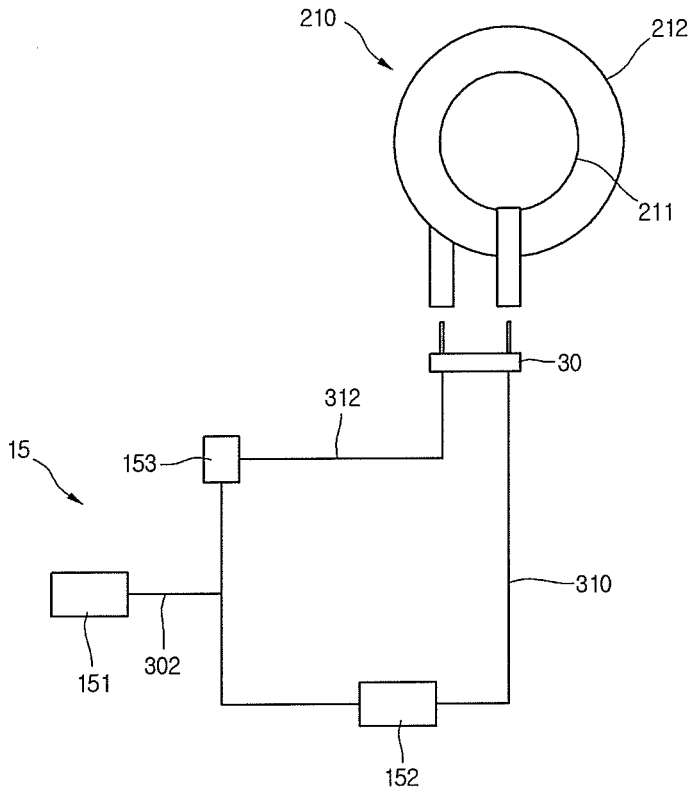
FIG. 4 is a schematic diagram of a gas valve unit according to an embodiment.

FIG. 4 is a schematic diagram of a gas valve unit or device according to an embodiment. Referring to FIG. 4, the gas valve unit or device 15 according to this embodiment may include a common valve 151, a common tube 302 connected to the common valve 151, first and second tubes 310 and 312 branched from the common tube 302, a first valve 152 disposed in the first tube 310, and a second valve 153 disposed in the second tube 312.

A gas to be supplied into the first pot 211 may flow through the first tube 310, and a gas to be supplied into the second pot 212 may flow through the second tube 312. The common tube 302, the first tube 310, and the second tube 312 may form the individual supply tube 16 described above.

The common valve 151 and the first valve 152 may each be a solenoid valve, for example. The solenoid valve may allow the gas to flow when it is turned on and may prevent the gas from flowing when it is turned off. That is, the solenoid valve may not adjust a flow rate of the gas when it is turned on.

On the other hand, the second valve 153 may be a linear valve capable of adjusting a flow rate of the gas, for example. The linear valve may adjust an opening degree of the valve to adjust a flow rate of the gas. Thus, as the second valve 153 may adjust the flow rate of the gas, an amount of gas supplied into the second pot 212 may be adjusted to adjust thermal energy of the second pot 212 in stages.

An operation of the cooking device according to an embodiment will be described hereinbelow.

When the adjustment knob 13 is manipulated to cook food or other items through the burner device 20, the mixed gas may be supplied into the burner pot 210. The mixed gas supplied into the burner pot 210 may be ignited by the ignition part 228 and burned. Then, the combustion member 230 may be heated by the heat generated by the combustion of the mixed gas.

Radiation energy of the combustion member 230 may have a visible light frequency band. Thus, a user may recognize that the cooking appliance 1 according to this embodiment is operating due to the visible light. Also, the food or other items may be heated by the combustion member 230 and also heated by conductive heat of the top plate 11. The gas burned by the combustion member 230 may flow through the burner frame 220, and then, may be exhausted outside of the cooking appliance 1 through the plurality of discharge hole 122 of the discharge part 12.

Figure 6A:
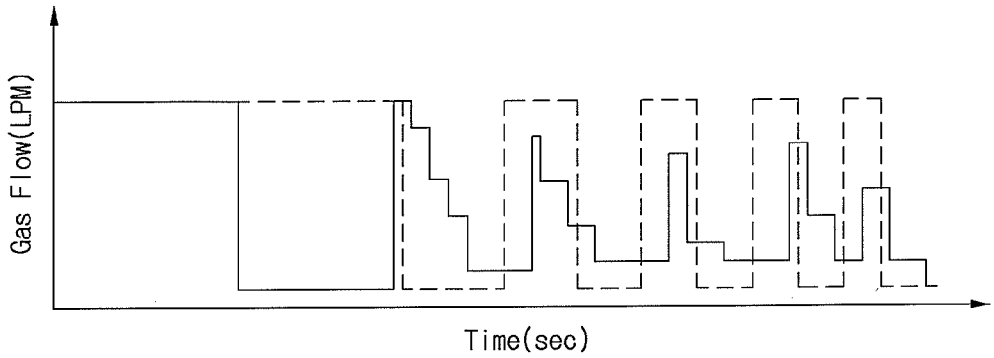
FIG. 6A is a graph showing a variation in time-varying flow rate when linear and solenoid valves are applied as a second valve.
Figure 6B:
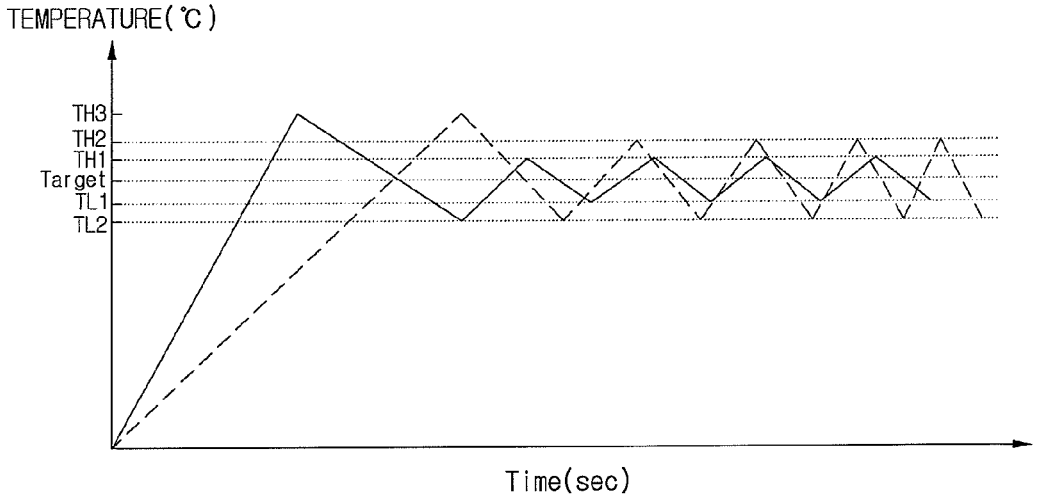
FIG. 6B is a graph showing a variation in time-varying temperature when the linear and solenoid valves are applied as the second valve.

FIG. 5 is a view illustrating a state of the gas valve unit depending on a thermal energy mode of the burner device according to an embodiment. FIG. 6A is a graph showing a variation in time-varying flow rate when linear and solenoid valves are applied as a second valve. FIG. 6B is a graph showing a variation in time-varying temperature when the linear and solenoid valves are applied as the second valve. In FIGS. 6A and 6B, the solid line is a graph when the second valve is a linear valve, and the dotted line is a graph when the second valve is a solenoid valve.

Referring to FIGS. 4 and 5, a user may select a thermal energy mode of the burner device 20 by manipulating the manipulation knob 13. For example, in this embodiment, the thermal energy mode of the burner device 20 may include high, middle, and low thermal energy modes. However, the thermal energy mode may be classified into a plurality of detailed thermal energy modes.

When the manipulation knob 13 is manipulated in its off state to select the low thermal energy mode, the common valve 151 and the first valve 152 may be turned on. On the other hand, the second valve 153 may be in a off state.

Then, the gas may pass through the common valve 151 and the first valve 152, and then, may be supplied into the first pot 211. Also, a mixed gas, in which the gas and the air supplied into the first pot 211 may be mixed with each other, may be ignited by the ignition part 228 and burned. Thus, only a portion of the combustion member 230, which corresponds to the first pot 211, may be heated.

When the manipulation knob 13 is manipulated to select the middle thermal energy mode, the common valve 151, the first valve 152, and the second valve 153 may be turned on. A portion of the second valve 153 may be opened in a state in which the second valve 153 is turned on. That is, an opening degree of the second valve 153 may be adjusted to a first opening degree in a range of about 0° to about 100°. Then, the mixed gas may be supplied into the first pot 211 and the second pot 212, and thus, the mixing gas in the second pot 212 may be burned.

When the manipulation knob 13 is manipulated to select the high thermal energy mode, the common valve 151, the first valve 152, and the second valve 153 may be turned on. The second valve 153 may be entirely opened (a second opening degree) in a state in which the second valve 153 is turned on. That is, the second opening degree of the second valve 153 may be greater than the first opening degree. The second opening degree may be about 100°, for example.

The thermal energy of the second pot 212 in the high thermal energy mode may be greater than the thermal energy of the second pot 212 in the middle thermal energy mode. Therefore, according to this embodiment, as the opening degree of the second valve 153 is adjusted, the second pot 212 may vary the thermal energy thereof.

In the high thermal energy mode, after the second valve 153 is entirely opened, the opening degree of the second valve 153 may be adjusted so that a temperature detected by the temperature sensor 229 satisfies a target temperature. In this embodiment, adjustment of the opening degree of the second valve 153 represents that a flow rate of the gas supplied into the second pot 212 may be adjusted. In the high thermal energy mode, when the second valve 153 is turned on, the second valve 153 may be entirely opened. When the second valve 153 is entirely opened, the mixed gas supplied into the second pot 212 may be ignited, and the combustion member 230 heated. Thus, a temperature detected by the temperature sensor 229 may increase.

Also, as the solid line in FIG. 6B, when the temperature detected by the temperature sensor 229 reaches a threshold temperature TH3, which may be higher than a target temperature, the second valve 153 may be reduced in opening degree in stages. Then, a temperature detected by the temperature sensor 229 may decrease.

When a temperature detected by the temperature sensor 229 reaches a second minimum temperature TL2, which may be less than the target temperature, the second valve 153 may increase in opening degree. When the temperature detected by the temperature sensor 229 increases and then reaches a first maximum reference temperature TH1, which may be higher than the target temperature, the second valve 153 may be reduced in opening degree in stages. When a temperature detected by the temperature sensor 229 reaches a first minimum temperature TL1, which may be lower than the target temperature, the second valve 153 may increase in opening degree in stages. The first maximum reference temperature TH1 may be lower than the threshold temperature TH3. That is, the second valve 153 may adjust its opening degree so that the temperature detected by the temperature sensor 229 may be maintained in a range of the first maximum reference temperature and the first minimum reference temperature in a state in which the second valve 153 is turned on, so as to maintain the target temperature.

If the second valve 153 is a solenoid valve, when a temperature detected by the temperature sensor 229 reaches the threshold temperature TH3 after the solenoid valve is turned on, the solenoid valve may be turned off. Then, a temperature detected by the temperature sensor 229 may decrease. Also, when a temperature detected by the temperature sensor 229 reaches the second minimum reference temperature TL2, which may be lower than the target temperature, the solenoid valve may be turned on again. When a temperature detected by the temperature sensor 229 increases and then reaches the second maximum reference temperature TH2, which may be higher than the target temperature, the solenoid valve may be turned off. That is, the second valve 153 may be repeatedly turned on and off so that the temperature detected by the temperature sensor 229 may be maintained in a range of the second maximum reference temperature TH3 and the second minimum reference temperature TL2.

Like this, when the solenoid valve is repeatedly turned on and off, the consumption power may increase according to the repeat on/off operations of the solenoid valve. Thus, so as to reduce a number of on/off operations of the solenoid valve, the second maximum reference temperature TH2, which may be an on/off reference temperature of the solenoid valve, may be set higher than the first maximum reference temperature TH1, and the second minimum temperature TL2 may be set lower than the first minimum temperature TL1.

In this case, as illustrated in FIG. 6A, to maintain the target temperature, if the second valve 153 is a solenoid valve, an amount of gas supplied into the second pot 212 may be greater than an amount of the gas supplied into the second pot 212 when the second valve 153 is a linear valve. When the solenoid valve is turned off, the supply of the gas into the second pot 212 may be blocked. On the other hand, when the solenoid valve is turned on, the gas may be supplied into the second pot 212 to reignite the mixed gas supplied into the second pot 212. Thus, noise may be generated every time the mixed gas is reignited.

Therefore, as described with respect to this embodiment, as the valve which is capable of adjusting the flow rate of the gas is the second valve 153, power consumption and the amount of gas supplied to maintain the target temperature may be reduced. Also, the second valve 153 may be maintained in a turned-on state to eliminate the reignition process of the mixed gas, thereby preventing ignition noise from being generated.

Although the method of adjusting the opening degree of the second valve in the high thermal energy mode has been described, the opening degree of the second valve in the middle thermal energy mode may be adjusted to maintain the target temperature according to the above-described method.

Figure 7:
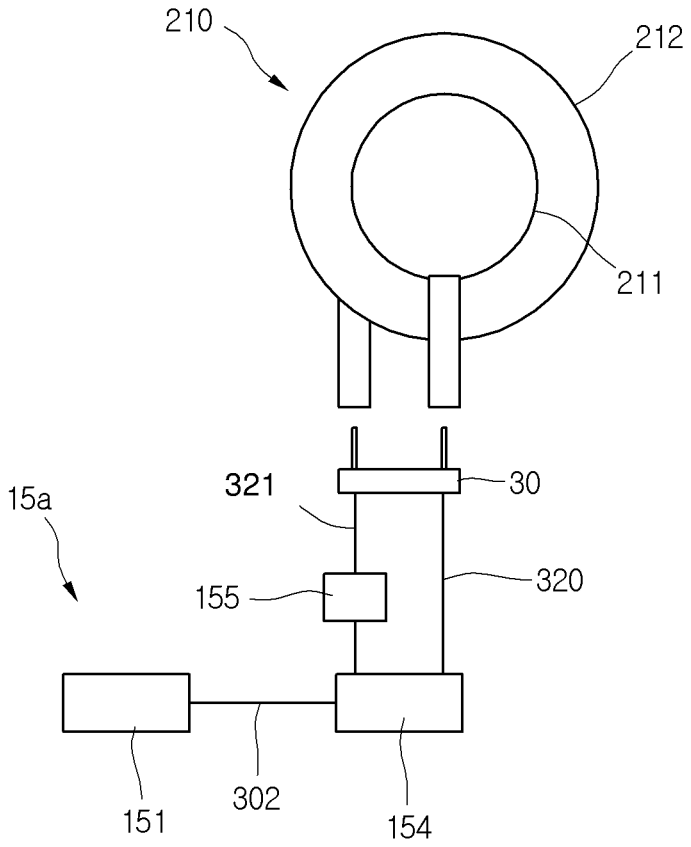
FIG. 7 is a schematic diagram of a gas valve unit according to another embodiment.

FIG. 7 is a schematic diagram of a gas valve unit or device according to another embodiment. Referring to FIG. 7, the gas valve unit or device 15*a* according to this embodiment may include common valve 151, common tube 302 connected to the common valve 151, a first valve 154 connected to the common tube 302, first and second tubes 320 and 321 branched from the first valve 154, and a second valve 155 disposed in the second tube 321. A gas to be supplied into first pot 211 may flow through the first tube 320, and a gas to be supplied into second pot 212 may flow through the second tube 321.

The common valve 151 and the first valve 154 may be a solenoid valve, for example. The first valve 154 may control the supply of the gas into the first and second pots 211 and 212. On the other hand, the second valve 154 may be a linear valve capable of adjusting a flow rate of the gas, for example. The linear valve may adjust an opening degree of the valve to adjust a flow rate of the gas.

Thus, according to this embodiment, as the valve to adjust the flow rate of the gas is disposed in the second tube 321, in which the gas to be supplied into the second pot 212 may flow, the thermal energy of the second pot 212 may be adjusted in multiple stages.

In the above-described embodiments, although the flow rate of the gas supplied into the second pot may be adjusted, a flow rate of the gas supplied into the first pot may also be adjusted. In this case, while the gas is continuously supplied into the second pot in each of the modes, the gas may be supplied into the first pot, or the supply of the gas into the first pot may be blocked according to the modes. When the gas is supplied into the first pot, the flow rate of the gas supplied into the first pot may be adjusted. Alternatively, the valve in each of the first and second pots may adjust the flow rate of the gas.

Embodiments disclosed herein provide a cooking appliance capable of adjusting thermal energy of a portion of a plurality of pots, which form a burner device or burner, in multi-stages.

Embodiments disclosed herein provide a cooking appliance that may include a case; a top plate seated on the case; a burner device or burner accommodated in the case; and a gas valve unit or device to adjust a flow rate of a gas supplied into the burner device. The burner device may include a burner pot including a first pot having a first mixing space, into which a mixed gas of a gas and air may be supplied, and a second pot having a second mixing space partitioned from the first mixing space to receive the mixed gas; and a combustion member to burn the mixing gas supplied into the first pot and the mixed gas supplied into the second pot. The gas valve device may include a first valve that allows the gas to be supplied into the first pot or prevents the gas from being supplied into the first pot. and a second valve that allows the gas to be supplied into the second pot or prevents the gas from being supplied into the second pot. At least one of the first valve or the second valve may adjust a flow rate of the gas.

Embodiments disclosed herein provide a cooking appliance that may include a case; a top plate seated on the case; a burner device or burner accommodated into the case; and a gas valve unit or device to adjust a flow rate of a gas supplied into the burner device. The burner device may include a burner pot including a first pot having a first mixing space, into which a mixed gas of a gas and air may be supplied, and a second pot having a second mixing space partitioned from the first mixing space to receive the mixed gas, and a combustion member to burn the mixing gas supplied into the first pot and the mixed gas supplied into the second pot. The gas valve device may include a first valve that allows the gas to be supplied into the first pot and the second pot or prevents the gas from being supplied into the first pot and the second pot; and a second valve to adjust a flow rate of the gas to be supplied into the second pot.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

a case;

a top plate seated on the case;

at least one burner accommodated in the case; and a gas valve device to adjust a flow rate of a gas supplied into the at least one burner, wherein the at least one burner includes:

a burner pot including a first pot having a first mixing space, into which a mixed gas of a gas and air is supplied, and a second pot having a second mixing space partitioned from the first mixing space to receive the mixed gas, the first pot being provided in the second port;

a first tube, through which the gas to be supplied into the first pot flows;

a second tube, through which the gas to be supplied into the second pot flows;

a combustion member provided above the burner pot and that burns the mixed gas supplied into the first pot and the mixed gas supplied into the second pot, the combustion member including a hole through which the mixed gas in the first pot and second pot passes, wherein the gas valve device includes:

a first valve to allow the gas to be supplied into the first pot and the second pot or prevents the gas from being supplied into the first pot and the second pot and provided in the first tube;

a second valve to adjust a flow rate of the gas to be supplied into the second pot and provided in the second tube; and a temperature sensor to detect a temperature of the at least one burner device, wherein the first valve is a solenoid valve, wherein the second valve is a flow rate-adjustable linear valve, wherein a thermal energy mode of the at least one burner includes a low thermal energy mode, at least one middle thermal energy mode, and a high thermal energy mode, wherein, in the low thermal energy mode, the first valve is turned on, and the second valve is turned off, and in the at least one middle energy thermal mode and the high thermal energy mode, the first valve and the second valve are turned on, and wherein the second valve in the at least one middle thermal energy mode has an opening degree less than an opening degree of the second valve in the high thermal energy mode, and wherein, in the at least one middle thermal energy mode or the high thermal energy mode, the opening degree of the second valve is adjusted according to the temperature detected by the temperature sensor, in the at least one middle thermal energy mode or the high thermal energy mode, when the detected temperature reaches a minimum reference temperature, the second valve is increased in opening degree, and when the detected temperature reaches a maximum reference temperature, the second valve is decreased in opening degree in stages so that the detected temperature ranges from the minimum reference temperature to the maximum reference temperature.

2. A cooking appliance, comprising:

a case;

a top plate seated on the case;

at least one burner accommodated in the case; and a gas valve device to adjust a flow rate of a gas supplied into the at least one burner, wherein the at least one burner includes:

a burner pot including a first pot having a first mixing space, into which a mixed gas of a gas and air is supplied, and a second pot having a second mixing space partitioned from the first mixing space to receive the mixed gas, the first pot being provided in the second pot;

a first tube, through which the gas to be supplied into the first pot flows;

a second tube, through which the gas to be supplied into the second pot flows; and a combustion member provided above the burner pot and that burns the mixed gas supplied into the first pot and the mixed gas supplied into the second pot, the combustion member including a hole through which the mixed gas in the first pot and second pot passes, wherein the gas valve device includes:

a first valve to allow the gas to be supplied into the first pot or prevents the gas from being supplied into the first pot and provided in the first tube;

a second valve to allow the gas to be supplied into the second pot or prevents the gas from being supplied into the second pot and provided in the second tube, wherein at least one of the first valve or the second valve adjusts a flow rate of the gas; and a temperature sensor to detect a temperature of the at least one burner, wherein the first valve is a solenoid valve, wherein the second valve is a flow rate-adjustable linear valve, wherein a thermal energy mode of the at least one burner includes a low thermal energy mode, at least one middle thermal energy mode, and a high thermal energy mode, wherein, in the low thermal energy mode, the first valve is turned on, and the second valve is turned off, and in the at least one middle thermal energy mode and the high thermal energy mode, the first valve and the second valve are turned on, and wherein the second valve in the at least one middle thermal energy mode has an opening degree less than an opening degree of the second valve in the high thermal energy mode, and wherein, in the at least one middle thermal energy mode or the high thermal energy mode, the opening degree of the second valve is adjusted according to the temperature detected by the temperature sensor, in the at least one middle thermal energy mode or the high thermal energy mode, when the detected temperature reaches a minimum reference temperature, the second valve is increased in opening degree, and when the detected temperature reaches a maximum reference temperature, the second valve is decreased in opening degree in stages so that the detected temperature ranges from the minimum reference temperature to the maximum reference temperature.

3. The cooking appliance according to claim 1, further including:

a common tube, to which the first and second tubes are connected; and a common valve connected to the common tube and electrically operated by the controller.

4. The cooking appliance according to claim 1, further including:

a common tube connected to the first valve; and a common valve connected to the common tube.

5. The cooking appliance according to claim 1, further including:

a burner frame provided on the burner pot so as to provide a discharge passage to discharge the mixed gas after the mixed gas is burned out of the case.

* * * * *